US007677963B2

(12) United States Patent
Bigoni

(10) Patent No.: US 7,677,963 B2
(45) Date of Patent: Mar. 16, 2010

(54) STRUCTURE FOR ENCLOSING AND ISOLATING A PACKAGING MACHINE FROM AN OUTSIDE ENVIRONMENT

(75) Inventor: Pietro Bigoni, Massa Lombarda (IT)

(73) Assignee: I.M.A. Industria Macchine Automatiche, Ozzano Emilia (Bologna) (IT)

( * ) Notice: Subject to any disclaimer, the term of this patent is extended or adjusted under 35 U.S.C. 154(b) by 0 days.

(21) Appl. No.: 10/560,613

(22) PCT Filed: Jun. 17, 2004

(86) PCT No.: PCT/IB2004/002050

§ 371 (c)(1),
(2), (4) Date: Dec. 14, 2005

(87) PCT Pub. No.: WO2004/110870

PCT Pub. Date: Dec. 23, 2004

(65) Prior Publication Data

US 2006/0141922 A1 Jun. 29, 2006

(30) Foreign Application Priority Data

Jun. 19, 2003 (IT) ..... BO2003A0375

(51) Int. Cl.
*E05D 15/06* (2006.01)

(52) U.S. Cl. ..... 454/187

(58) Field of Classification Search ..... 454/187, 454/56, 57

See application file for complete search history.

(56) References Cited

U.S. PATENT DOCUMENTS

| | | | | | |
|---|---|---|---|---|---|
| 4,489,645 | A | * | 12/1984 | Sirch et al. | 454/187 |
| 4,723,480 | A | * | 2/1988 | Yagi et al. | 454/57 |
| 4,967,645 | A | * | 11/1990 | Mattson | 454/296 |
| 5,312,294 | A | | 5/1994 | Meline | |
| 5,997,399 | A | * | 12/1999 | Szatmary | 454/187 |
| 6,517,428 | B1 | * | 2/2003 | Murray et al. | 454/56 |
| 2004/0134128 | A1 | * | 7/2004 | Berry et al. | 49/231 |
| 2004/0172882 | A1 | * | 9/2004 | Kern et al. | 49/231 |
| 2004/0206004 | A1 | * | 10/2004 | Kalempa et al. | 49/370 |

FOREIGN PATENT DOCUMENTS

DE 38 11 780 A 10/1989

* cited by examiner

*Primary Examiner*—Steven B McAllister
*Assistant Examiner*—Samantha A Miller
(74) *Attorney, Agent, or Firm*—William J. Sapone; Coleman Sudol Sapone P.C.

(57) ABSTRACT

An enclosing structure (S), in particular for enclosing and isolating outer environment of a packaging machine includes a plurality of enclosing panels (2), suitably and air-tightly assembled. At least one of the panels (2) defines a separating surface (1) for separating two different environments (A,B). Conveying means for conveying flows of purified air (F,F1, F2,F3,F4) are associated to the panel (2) to define, together therewith, a fluid-dynamic barrier, which avoids relative contamination between one environment (A) and the other environment (B).

5 Claims, 4 Drawing Sheets

STRUCTURE FOR ENCLOSING AND ISOLATING A PACKAGING MACHINE FROM AN OUTSIDE ENVIRONMENT

FIELD OF THE INVENTION

The present invention relates to packaging articles in a protected environment.

In particular, the invention relates to a structure for enclosing a packaging machine in order to isolate it from the outside environment, so as to prevent it from contaminations by the agents present in the outside surrounding area.

BACKGROUND OF THE INVENTION

In the field of the automatic packaging machines, in particular machines for packaging pharmaceutical products into containers, to which the following description refers explicitly without losing its generality, packaging machines, or parts thereof, are often isolated with respect to the outside environment, in order to prevent the product being packaged, or the containers being filled, from contamination.

In general, if the pharmaceutical product to be packaged is dangerous for the health of operators who work near the packaging machines, it is also essential to avoid spreading of remains or parts of the product in the surrounding area.

For this purpose, specific solutions for packaging pharmaceutical products in a controlled atmosphere have been proposed.

These solutions include apparatuses aimed at providing a protected environment for packing, that is a complete isolation of the whole packaging machine and in general of the whole packaging area from the outside area, in order to avoid any type of cross contamination between the product being packaged, containers and the outside environment.

The above mentioned apparatuses usually include enclosing structures for isolating the packaging machine in environments or chambers with a controlled purity, and having systems for sterilization and decontamination, as well as complicated systems for micro filtrations of the air exchanged with the outside.

The above mentioned structures have shutters, with suitable seals, aimed at allowing the technical staff, responsible for correct operation of the working parts of the packaging machine and/or for its maintenance, to accede thereinto.

At present, since they have to maintain very high isolation standards, the above apparatuses must be very complicated and sophisticated structurally and functionally, and moreover, they are very expensive.

Moreover, since the shutters are kept air-tight only by the seals, which very often tend to wear and deform, eventually in an uncontrolled way, the best measure to isolate the above described enclosing structures from the outside environment is the frequent substitution of the seals, which results in considerable waste of time.

SUMMARY OF THE INVENTION

The object of the present invention is to propose a enclosing structure, which overcomes the drawbacks and problems of the above described technique.

In particular, an object of the present invention is to propose a enclosing structure, which ensures best and long-lasting isolation from the outside environment also during normal interventions of the operators responsible for the maintenance and operational control of the same packaging machine.

An enclosing structure is provided according to the present invention, in particular for enclosing and isolating a packaging machine from the outside environment, the structure being characterized in that it includes enclosing panel-shaped means suitably air-tight assembled together, said panel means including at least one separating surface defining panel, for separating two different environments; conveying means for conveying flows of purified air, associated to said separating surface defining panel to form, together with said separating surface defining panel, a fluid-dynamic barrier avoiding contamination between said environments.

BRIEF DESCRIPTION OF THE DRAWINGS

The characteristic features of the invention, as they will appear also from the claims, will be pointed out in the following detailed description of a preferred, but not limiting embodiment of an enclosing structure, with reference to the enclosed figures, in which:

BEST MODES OF CARRYING OUT THE INVENTION

Figure 1:
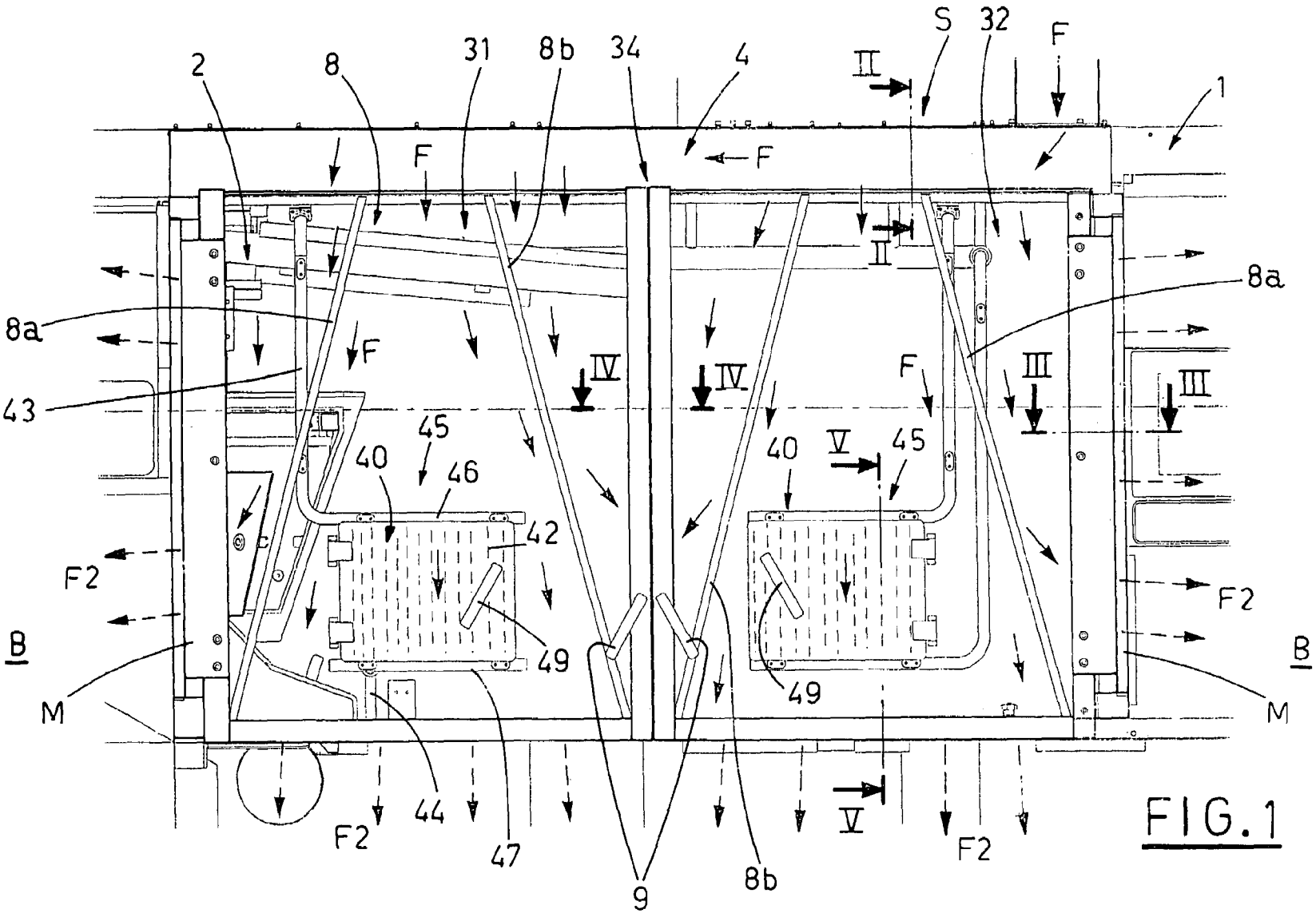
FIG. 1 is a schematic front view, with some parts removed for sake of clarity, of a preferred embodiment of the proposed enclosing structure.
Figure 3:
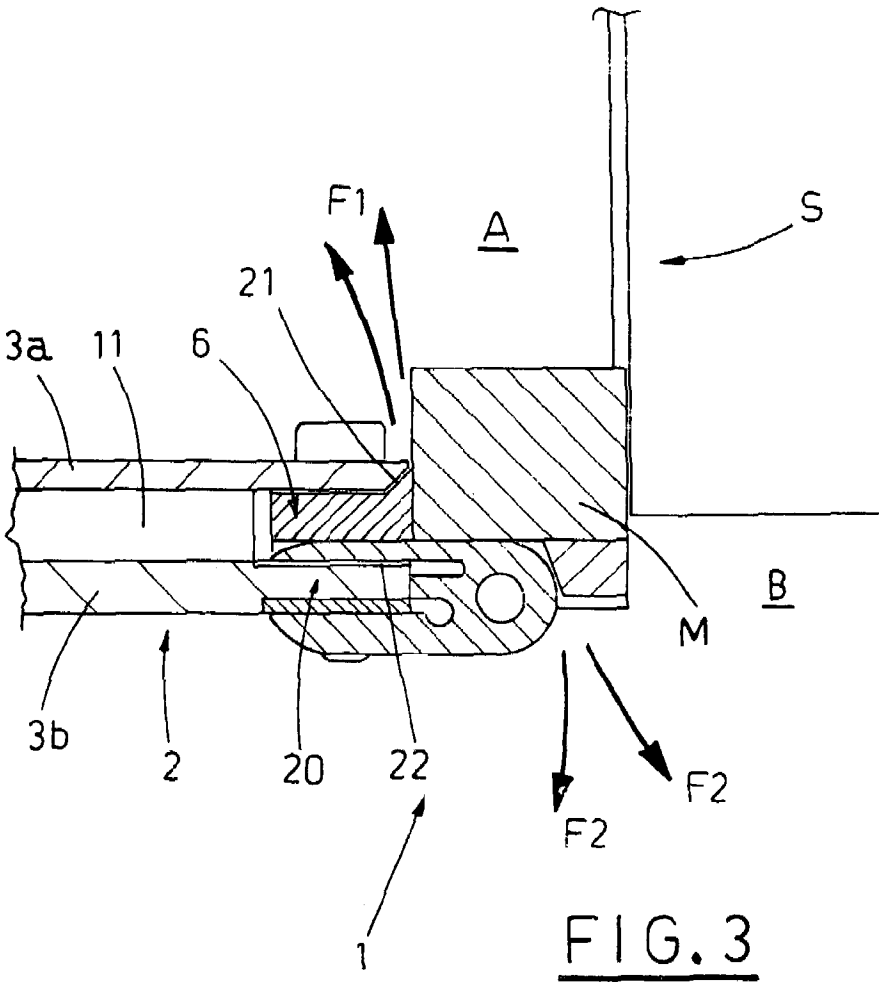
FIG. 3 is top, enlarged, section view, taken along line III-III of another detail of the structure of FIG. 1.
Figure 5A:
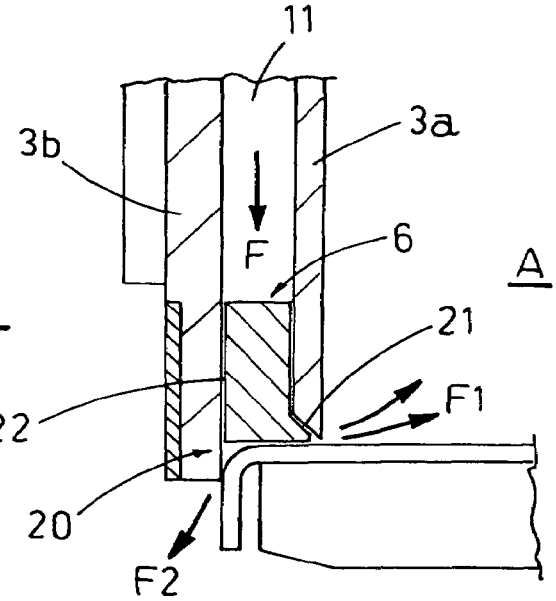
FIG. 5*a* is a detailed and enlarged view of a variant of the detail of FIG. 5.
Figure 5:
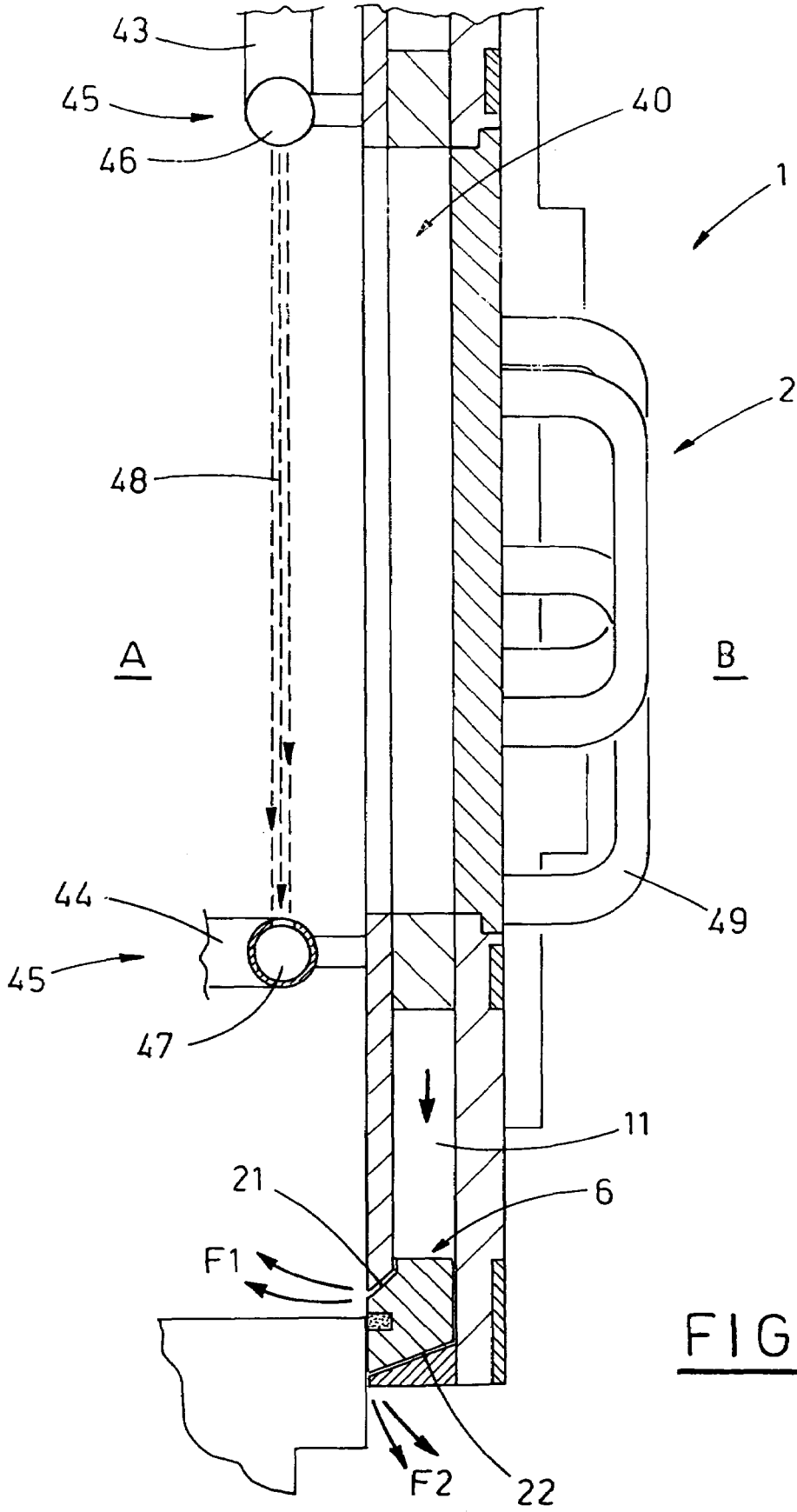
FIG. 5 is a lateral, enlarged section view, taken along line V-V of a further detail of the structure of FIG. 1.

With reference to FIGS. 1, 3 and 5, reference numeral 1 indicates a separating surface, aimed at separating and isolating two different environments A and B.

In particular, the surface 1 is a part of a enclosing panel-type structure S, formed by air-tight assembling a plurality of isolating panels and aimed at creating the whole isolating enclosure of a packaging machine for a pharmaceutical production (known and not shown in the enclosed figures), inside an environment A, closed and isolated from the outside environment B.

The inner environment A, where the packaging machine is situated, must be isolated from the outside environment B in order to avoid contamination of the packaging machine and consequently, of the pharmaceutical product packaged thereby, by substances and microorganisms present in the outside environment, and at the same time to prevent the outside environment from the contamination by remains and powders released by the pharmaceutical product during various packaging steps.

Particularly, the surface 1 is defined preferably by a vertical front panel 2 of the panel structure S, but it could be defined by a corresponding lateral or rear panel of the structure S, without limiting the proposed invention.

Moreover, the structure S could be wholly or partially formed by a plurality of panels 2, each of which defines a relative separating surface 1.

The panel 2 includes a pair of substantially mirror-like wings 31, 32, which can be opened by means of hinges applied to uprights M of the structure S at the opposite vertical ends of the panel 2.

The wings 31, 32 join each other in an intermediate area 34 and they have handles 9, which are turned toward the outside environment B for opening and closing the wings.

According to what is shown in FIGS. 2, 3, 4 and 5*a*, each of the wings 31, 32 includes an inner panel 3*a* and an outer panel 3*b* (that is turned toward the environment B), which are substantially parallel and are joined together and fastened to a frame 6 at a prefixed distance.

The space between the panels 3*a* and 3*b* and the frame 6 forms an intermediate space 11, extending along the whole length of the wings 31, 32.

Figure 2:
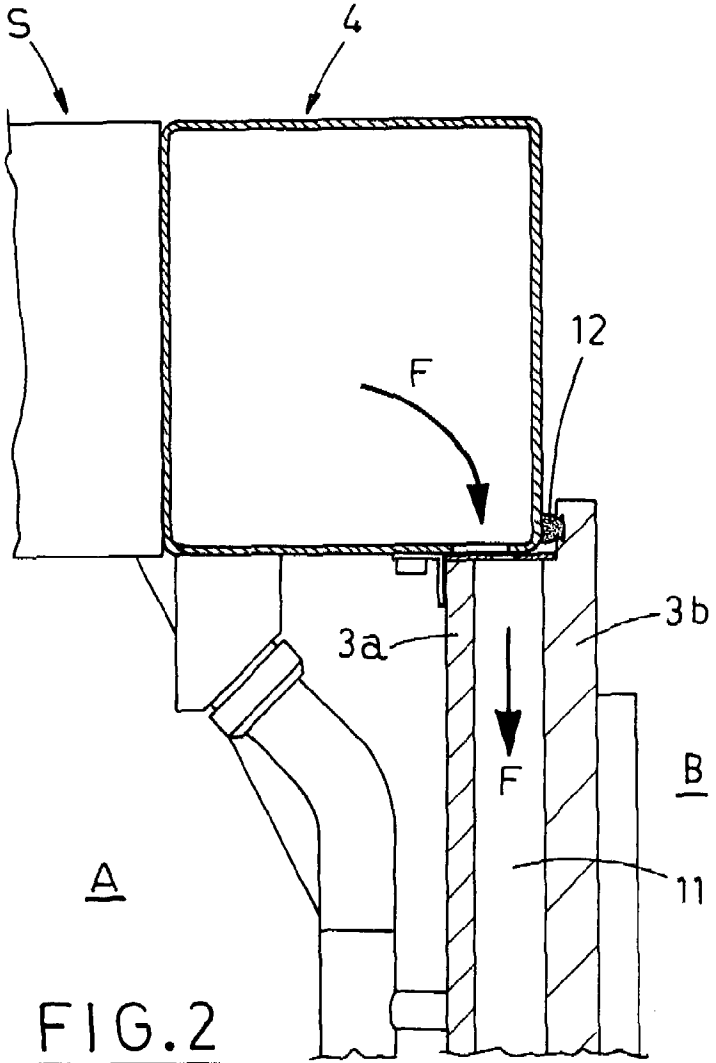
FIG. 2 is a top, enlarged, partially section view, taken along line II-II, of a detail of the structure of FIG. 1.

According to FIG. 2, the structure S has means 4 for feeding air under pressure, coming from a source of compressed air, suitably purified by filtering means (not shown).

The means 4 are situated over the panel 2 and feed and convey a flow F of purified air into the intermediate space 11.

The means 4 include in particular a duct 4, situated near the outer upper edge of the panel 2 and touching the upper edge of the wings 31, 32.

The duct 4 is set in communication with the intermediate space 11 by apertures, known and not shown in FIG. 2 for sake of simplicity, suitably made in the duct 4 and in the wings 31, 32.

A seal 12 is situated on the upper edge of the wings 31, 32, precisely between the panel 3*b* and the duct 4.

The seal 12 prevents the flow of not purified air from passing from the environment B into the intermediate space 11, because of the drop in pressure due to venturi effect.

According to FIGS. 3, 4, 4*a* and 5*a*, near the lateral adjacent edges of the wings 31, 32 of the panel 2, there are means 20 for conveying/distributing the flow F of purified air circulating in the intermediate space 11, from the intermediate space 11 toward both environments, isolated A and outer B, in a way explained later on.

The conveying/distributing means 20 include, near the frame 6 of each of the wings 31, 32 of the front panel 2, defining the surface 1, a channel 22 and a channel 21 for each lateral panel of the relative wing 31, 32.

The channel 21 sets the intermediate space 11 in communication with the environment A (that is the environment, in which the packaging machine is situated); and the channel 22 sets the intermediate space 11 in communication with the outer environment B.

The channels 21, 22 are suitably sized and inclined slots, which extend substantially along the whole length of the outer edges of the panel 2, so as to allow the two partial flows F1 and F2 of purified air to circulate along the channels 21 and 22.

The two partial flows F1 and F2 are generated by subdividing the flow F, with the partial flow F1 directed along the channel 21 solely from the intermediate space 11 to the environment A and with the partial flow F2 directed along the channel 22 solely from the intermediate space 11 to the outer environment B (FIGS. 3, 5 and 5*a*).

In this way, when in use, the partial flows F1 and F2 define a fluid dynamic barrier associated to the surface 1, which maintains the environment A pneumatically isolated from the outer environment B.

In particular, FIGS. 5 and 5*a* show two different variants of the shape of the calibrated slots defined by the channels 21 and 22, corresponding to two different abutment configurations of the panel 2 of the enclosing structure S.

The differences between the two variants depend mainly on the different form possibly assumed by the frame 6.

Figure 4:
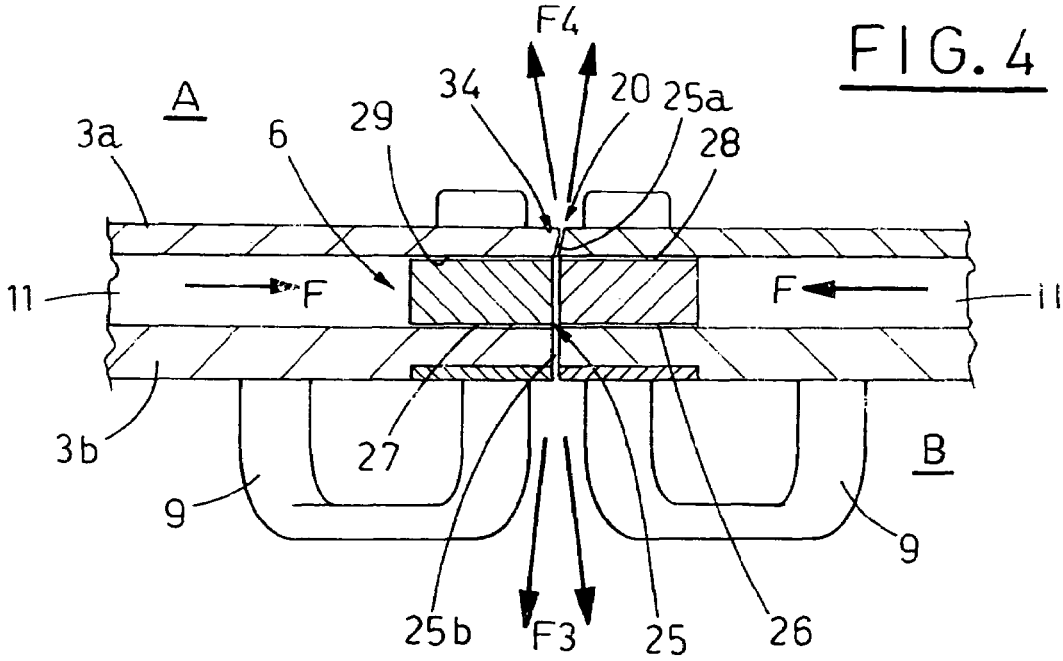
FIG. 4 is a top, enlarged, section view, taken along line IV-IV of a further detail of the structure of FIG. 1.
Figure 4A:
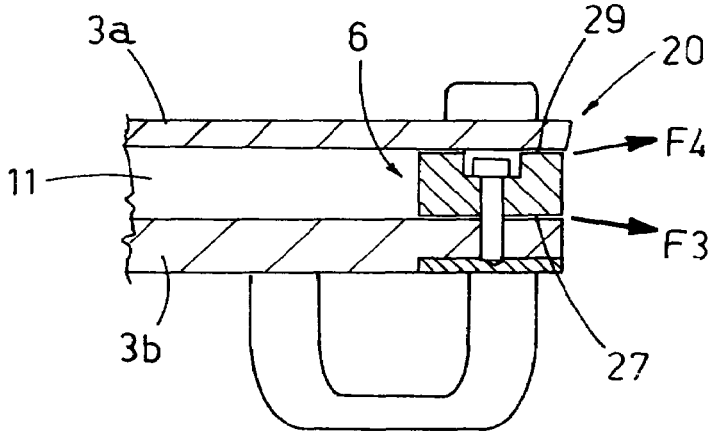
FIG. 4*a* is an enlarged view of a detail of FIG. 4.

According to FIG. 4, the conveying/distributing means 20 include also, in the intermediate area 34 between the wings 31, 32, a channel 25 defined by the opposite lateral edges of the wings 31, 32 as deep as the whole thickness of the latter.

The channel 25 communicates with the intermediate spaces 11 of the wings 31, 32 by respective slots 26 and 27 made between the frame 6 and the outer panel 3*b*, and by slots 28 and 29 made between the frame 6 and the inner panel 3*a*.

In this way, the slots 26 and 27 set the intermediate spaces 11 of the wings 31, 32 in communication with the outer environment B, in order to allow the circulation of a partial flow of air F3 generated by sub-division of the flow F and directed solely from the intermediate space 11 to the environment B, while the slots 28 and 29 set the intermediate spaces 11 of the wings 31, 32 in communication with the inner environment A, in order to allow the circulation of a partial flow of air F4, likewise generated by sub-division of the flow F and directed solely from the intermediate space 11 to the environment A.

Like the above described partial flows F1 and F2, the partial flows F3 and F4 define a fluid dynamic barrier associated to the surface 1 of the structure S, which maintains the environment A perfectly and pneumatically isolated and protected from the outer environment B.

Moreover, the dimension of the inner portion 25*a* of the channel 25, where the inner panels 3*a* of the wings 31, 32 join, is smaller than the outer portion 25*b* of the same channel 25 and is oriented in a different way with respect to the latter.

This allows to regulate differently the partial flows of air F4 and F3, directed respectively to the environment A and to the outer environment B, and supplies a stop element for better centering the wings 31, 32 with respect to each other.

According to FIG. 1, the panel 2 has also deflector means 8, situated inside the intermediate space 11 and aimed at diverting a part of the flow of air F laterally to the intermediate space 11, to facilitate the generation of the partial flows F1 and F2.

In particular, the deflector means 8 include, for each wing 31, 32, a pair of baffle plates 8*a* and 8*b*, inclined and diverging (FIG. 1).

According to what is better shown in FIGS. 1 and 5, an inspection aperture 40 is made in each wing 31, 32 of the panel 2, and has an air-tight closure shutter 42.

The shutter 42 has handles 49 situated in the environment B, which allow to open and close it.

The inspection aperture 40 allows to inspect the environment A and the packaging machine situated therein during the machine operation, without contaminating the environment A.

In fact, isolating means 45, likewise of the type defining a fluid-dynamic barrier, are situated in the inner part of the inspection aperture 40 and are aimed at preventing the exchange of considerable amounts of air between the environment A and the outer environment B, not protected during the short periods, in which the shutter 42 is open, e.g. during maintenance activities such as removal of small obstructions in the feeding of the products being packaged and other similar quick operations.

For this purpose, the isolating means 45 (FIG. 5) include a conduit 46 and a conduit 47.

The conduit 46 is fastened to the inner panel 3*a* of the panel 2 near the upper edge of the inspection aperture 40.

The conduit 46 is connected to a source of purified compressed air (not shown), by a main pipe 43, and has a plurality of nozzles (not shown) turned downwards, parallel to the extension of the inspection aperture 40, to spread purified compressed air (air flow 48 in FIG. 5) directed vertically toward the conduit 47.

The conduit 47 is fastened to the inner panel 3*a* near the lower edge of the aperture 40, parallel to the pressurized conduit 46, and is connected to a source of vacuum by a suction pipe 44.

The conduit 47 has a plurality of apertures (not shown), aimed at sucking the vertical jets of air going out from the nozzles of the conduit 46.

Therefore, the conduit 46 and the conduit 47 cooperate to create a fluid-dynamic barrier (of the type known as "air knife"), extending along the whole length of the aperture 40 at least for the periods, when the shutter 42 is open.

For this purpose, suitable sensors and actuators for stopping and activating the air knife can be used, according to known techniques, which will not be further explained.

In this way, the operator responsible for small maintenance operations can intervene from the inside of the environment by moving his/her hands, which pass through the aperture 40 without contamination, due to the fluid-dynamic barrier created by the vertical flow of compressed air 48, which "washes" the operator's hands, removing therefrom possible contaminating inside or outside particles, created by e.g. powders released by the product being packaged by the packaging machine.

It is to be noted that the structure S having the surface 1 is particularly advantageous, because it reduces the use of seals to only one seal 12, enough to ensure an efficient isolation between the inner and outer environments, and thus it reduces frequent periodical substitutions of the seal, to avoid its deformation and wear.

Consequently, the machine downtimes are reduced and its handling costs are reduced.

It is understood that what above has been described as a pure, not limiting example. Therefore, possible changes and variants of the invention remain within the protective scope of the present invention, as described above and claimed below.

The invention claimed is:

1. An enclosing structure for enclosing and isolating a packaging machine from an outer environment comprising:

one or more enclosing panel means assembled together to define an inner environment within which the packaging machine is located, at least one juncture located adjacent an edge of the one or more enclosing panel means, at least one enclosing panel means being a movable wing, hinged to an upright of the enclosing structure, said one or more enclosing panel means separating the inner environment of the enclosing structure which is substantially enclosed and isolated from the outer environment, said movable wing being formed by a first panel and a second panel, fixed together in a facing relation on opposite sides of a frame, the first panel and the second panel being fixed at a distance relative to each other to form an intermediate space therebetween, a flow of purified air being circulatable through said intermediate space, the movable wing having at least one air sealable end;

said first panel facing said inner environment and having at least one inner air conveying channel for passing purified air from the intermediate space past the frame and into the inner environment, the inner air conveying channel situated near at least one edge of said first panel disposed at said at least one air sealable end of said movable wing, said inner air conveying channel being in fluid communication with said inner environment, so that a flow of purified air passes from the intermediate space through the inner air conveying channel toward the inner environment at the at least one edge of said first panel;

said second panel facing said outer environment and having at least one outer air conveying channel for passing purified air from the intermediate space past the frame and to the outer environment, the outer air conveying channel situated near at least one edge of said second panel disposed at said at least one air sealable end of said movable wing, said outer air conveying channel being in fluid communication with said outer environment, so that a flow of purified air passes from said intermediate space through said outer air conveying channel toward the outer environment at the at least one edge of said second panel, the purified air passing through the inner conveying channel and the outer conveying channel forming a fluid-dynamic sealing barrier at the at least one air sealable end of said movable wing for preventing contaminants from entering the inner environment at the at least one air sealable end of said movable wing.

2. The structure as claimed in claim 1 further comprising diverting baffle plates situated in said intermediate space for facilitating conveyance of said flow of purified air toward said inner and outer conveying channels.

3. The structure as claimed in claim 1 wherein at least two adjacent panel means are each movable wings, hinged to uprights of the structure, the two wings having air sealable ends in a facing relation defining an intermediate area therebetween, a further channel being defined by the opposed air sealable ends of the wings in said intermediate area; said further channel being in fluid communication with the intermediate space of each of said wings, each of which has inner conveying channels and outer conveying channels which direct purified air into the further channel, a flow of purified air circulating through said further channel directed from said intermediate space to said outer environment; and a flow of purified air circulating through said further channel directed from said intermediate space to said inner isolated environment, such that no contaminants can pass through the intermediate area to contaminate the inner environment.

4. The structure as claimed in claim 1 further comprising at least one inspection aperture made in a panel means, said aperture having isolating pneumatic means coupled thereto to form a fluid-dynamic barrier extending along an entire length of the aperture.

5. The structure as claimed in claim 4 wherein said isolating pneumatic means include at least one first conduit and at least one second conduit, situated on opposite sides of said aperture, said first conduit having a series of nozzles for delivering compressed purified air directed towards said second conduit, said second conduit having openings for receiving the air coming from the nozzles of said first conduit to provide an air curtain therebetween.

* * * * *